US005205307A

United States Patent [19]

Di Stefano et al.

[11] Patent Number: 5,205,307

[45] Date of Patent: Apr. 27, 1993

[54] SYSTEM FOR CLEANING CONTAMINANTS FROM PARTS

[75] Inventors: Robert P. Di Stefano, New Rochelle; Richard E. Knipe, Jr., Monsey, both of N.Y.; Sheldon R. Green, Thomaston, Conn.

[73] Assignee: American Polychemical Manufacturing Corp., Spring Valley, N.Y.

[21] Appl. No.: 843,314

[22] Filed: Feb. 28, 1992

[51] Int. Cl.[5] ..... B08B 3/04

[52] U.S. Cl. ..... 134/104.4; 134/109; 134/199

[58] Field of Search ..... 134/104.2, 104.4, 109, 134/111, 151, 155, 186, 198, 199

[56] References Cited

U.S. PATENT DOCUMENTS

| | | | |
|---|---|---|---|
| 1,545,979 | 7/1925 | Rosenberg | 134/104.4 |
| 3,033,712 | 5/1962 | Brevik | 134/186 X |
| 3,741,235 | 6/1973 | Ambrose et al. | 134/104.4 X |

FOREIGN PATENT DOCUMENTS

| | | | |
|---|---|---|---|
| 923652 | 4/1982 | U.S.S.R. | 134/104.2 |
| 553319 | 5/1943 | United Kingdom | 134/104.4 |

*Primary Examiner*—Philip R. Coe
*Attorney, Agent, or Firm*—Notaro & Michalos

[57] ABSTRACT

A retrofit manifold, system and process for converting a solvent vapor degreaser to an aqueous solution degreaser is provided for an efficient and environmentally safe method for removing contaminants from workpieces, manufactured articles and other parts. A uniquely designed agitation manifold is fitted at the back wall of the wash tank. Unclean workpieces are submerged in hot aqueous solution in the wash tank and are positioned in the wash tank in front of the agitation manifold. A plurality of nozzles arranged at each section of the manifold spray aqueous solution at the workpieces. Oil based contaminants separated from the workpieces are collected at the surface of the aqueous solution and exited from the tank along with a quantity of aqueous solution. The contaminants are removed from the system and the aqueous solution is recycled back into the wash tank.

11 Claims, 5 Drawing Sheets

SYSTEM FOR CLEANING CONTAMINANTS FROM PARTS

FIELD AND BACKGROUND OF THE INVENTION

The present invention relates to a retrofit manifold, system and process for converting a solvent vapor degreaser to an aqueous solution degreaser for the removal of contaminants from workpieces, manufactured articles and other parts.

A wide variety of methods and devices are known for degreasing or otherwise removing contaminants from the surfaces of parts. One common technique is to use a vapor degreaser which consists of a tank filled with a liquid solvent. The contaminated pieces, articles or parts are suspended over the solution in a basket so that the vapors from the liquid solvent solution dissolve the contaminants and cause the contaminants to separate from the articles and drip down into the solvent below.

Most often the contaminant has an oil base which causes the contaminants to mix with the solvent once it is removed from the parts. A major problem associated with vapor degreasers is that the solvent is highly volatile, noxious and not readily degradable in the environment. Also, such solvents include fluorinated and chlorinated hydrocarbons which have also been found to deplete the ozone layer in the upper atmosphere. In addition, cleaning solvents often are flammable, toxic and constitute "hazardous waste" which require specialized handling when they must be discarded.

Due to the hazards of using vapor degreasers and their solvents and the danger to the environment, aqueous solution degreasers have been developed as a solution to the problem. The aqueous or water based solutions that are used for the aqueous solution degreasers for removing contaminants from parts or articles alleviate the many problems that were associated with the vapor degreasers. The aqueous degreasers come in several varieties such as those that consist of a tank in which a basket of parts or articles is suspended and solution is sprayed from manifolds or pipes through nozzle attachments. By spraying the aqueous solution the contaminants are removed from the parts and are later drained or skimmed from the tank. Other types of aqueous degreasers consist of directly submerging the parts or articles in the solution itself. The aqueous solution is then allowed to react and remove the contaminants and is later removed from the tank.

U.S. Pat. No. 4,651,762 to Bowden and U.S. Pat. No. 4,082,867 to Henley, et al. both disclose the use of water based or aqueous, emulsion forming cleaning solutions for removing oil from manufactured articles. Both patents advocate the use of agitation and separate the oil from the cleaner to allow reuse of the cleaner. After cleaning the articles, oil is removed from the aqueous solution using a skimming technique, taking advantage of the fact that the lighter oil floats to the surface.

U.S. Pat. No. 4,844,743 to Koblenzer, et al. discloses a method and system for cleaning work pieces with a liquid solvent put in a treatment chamber or tank in which the work pieces are submerged. A series of manifolds are employed so that the nozzles on the manifold spray liquid solvent from both a top and bottom direction within the tank.

U.S. Pat. No. 3,888,693 to Schevey, et al. discloses a multi-phase rinse and recovery method using an apparatus that removes and recovers contaminated liquid from unclean articles once they are submerged within a tank. A series of nozzles are employed so that the liquid is sprayed in three directions. The liquid is sprayed at the contaminated articles from left to right, right to left and bottom to top.

U.S. Pat. No. 5,051,135 to Tanaka, et al. discloses a cleaning method using a solvent while preventing the discharge of the solvent vapors to the environment. A tank is utilized having a manifold with nozzles located at the top of the tank. The nozzles at the top of the tank spray liquid solvent from the top of the tank to the bottom of the tank thereby cleaning contaminated articles.

Although there has been a shift in the use of degreasing apparatus from the older style vapor degreasers to the use of aqueous solution degreasers, a fully satisfactory, economical and efficient method and system still has not been developed for converting the older style solvent vapor degreasers to the environmentally safe aqueous solution degreasers.

SUMMARY OF THE INVENTION

The present invention comprises a retrofit manifold, system and process for converting solvent vapor degreasers to aqueous solution degreasers.

The invention utilizes current vapor degreaser apparatus technology and consists of the existing tank, water separator, spray reservoir and cascade pump. Additionally, each tank of a vapor degreaser is fitted with a unique and newly designed manifold with prearranged nozzles for cleaning contaminated parts in a most efficient manner.

The newly fitted agitation manifold consist of stainless steel piping which is secured inside a vapor degreaser tank at the back wall of the tank. The agitation manifold is constructed of one and one half inch diameter stainless steel pipe with threaded nozzles that have proven to be more efficient due to maintenance considerations. The manifold has a series of nozzles arranged over three distinct areas of the manifold. The first series of nozzles is arranged in the vertical uppermost portion of the manifold and the nozzles are positioned such that aqueous solution is sprayed at the contaminated parts inside the tank. The second series of nozzles is arranged at the middle horizontal portion of the manifold and sprays aqueous solution from the back wall of the tank directly to the front wall of the tank with such force insuring that the aqueous solution is reflected from the front wall back toward the manifold. The third series of nozzles spray aqueous solution at the contaminated parts inside the tank and are located at the lower vertical portion of the manifold. Ideally the aqueous solution is pumped through the manifold nozzles at 20 to 40 psi for the most efficient cleaning of contaminated parts.

The location of the agitation manifold is critical to the conversion of a vapor degreaser to an aqueous degreaser. In order to capitalize on efficiency and space, the manifold is secured to the tank against the back wall of the tank. Because of the toxic vapors that are associated with vapor degreasing and the generally thin skinned tanks that are used in vapor degreasing, it was found that conventional welding of the manifold was not possible. Not only was there a lack of breathable air for the welder, but also a problem existed whereby the tank could fracture if welding equipment was used due to the toxic vapors existing in the tank. Additionally, securing the manifold to the tank through the use of bolts was discounted, due to the risk of causing a leak in the tank and a problem in that a thin skinned tank structure is incapable of supporting a bolt.

An effective method of securing the manifold to the tank without enduring the risks listed above is through the use of a fastening means consisting of a telescope and turnbuckle pipe arrangement. Two turnbuckle pipes are preattached to the manifold at each vertical end and extend horizontally to the front wall of the tank. The opposite ends of the turnbuckle pipe have a flat plate which is designed to rest flush up against the front wall of the tank. These fastening means also have a special receiving arrangement whereby a special tool of significant length allows a user to reach into the tank through its top and engage the receiving arrangement in order to extend the turnbuckle pipe outwardly toward the front end of the tank. Through use of the special tool, the turnbuckle pipe is eventually extended out so that the plate is pressed flat up against the front wall of the tank thereby securing the agitation manifold within the tank.

The entire system is then filled with hot aqueous solution so that a continuous flow of hot aqueous solution may be maintained. At the outset, the tank is filled with hot aqueous solution to a level just below a trough that is located near the top of the tank in the standard vapor degreaser. A perforated basket containing contaminated parts and articles is submerged in the hot aqueous solution and is located before the agitation manifold period. The basket of contaminated parts is arranged such that the three separate areas of the manifold containing the prearranged nozzles at the vertical uppermost portion, the middle horizontal portion, and the lower vertical portion of the manifold can spray hot aqueous solution at the contaminated parts. Also, due to the unique arrangement of the middle horizontal portion of the manifold with its nozzles, aqueous solution is sprayed directly to the front wall of the tank such that the solution is forced back off the front wall to the manifold and the awaiting perforated basket of parts. The unique design of the agitation manifold allows for the solution that is forced off the front wall of the tank to be directed at the spacing between the flow pattern eminating from the nozzles on the horizontal portion of the manifold. Additionally, there is a relationship between the flow rate and the amount of fluid in the tank. A general rule is usually one half the gallon capacity as gpm.

Because of the constant agitation caused by the spraying action of the nozzles on the manifold, the contaminants are removed from the contaminated articles and due to their composition which is usually oil based, float on top of the surface of the aqueous solution. The aqueous solution fluid level of the tank is purposely agitated above the trough located at the top of the tank so that the contaminants floating on top of the solution are collected in the trough along with some of the solution. The trough is arranged in each tank with a pitch such that contaminants may travel along with solution to an exit point leading outside of the tank. The exit point in the tank is a discharge pipe which allows the solution with contaminated particles to flow out of the tank and into a water separator. Once inside the water separator, the contaminants that are floating on top of the solution are bled out of the water separator through a contaminant outlet. The rest of the solution without the majority of contaminants which have already been bled off are allowed to flow down to the spray reservoir located directly beneath the water separator. Solution syphoned off into the water separator is allowed to travel to the spray reservoir. Fresh aqueous solution in conjunction with the recycled aqueous solution enable the spray reservoir to contain the purest concentration of aqueous solution found in the system. The spray reservoir with its pure concentration of solution pumps the aqueous solution back into the tank through the cascade pump. The cascade pump contains a rigid filter usually in the form of a polypropylene filter so that it is capable of withstanding the great pressure caused by this pump, while at the same time trapping any contaminants which may still be left in the solution. The cascade pump is adjusted to provide at least a minimum volume of one minute of retention time in order to allow the contaminants to separate from the solution.

The aqueous solution pumped through the cascade pump is sent again through the agitation manifold located inside the tank, causing the agitation manifold to spray aqueous solution that has been recycled through the system.

This type of self contained system has proven to be very efficient and environmentally safe. Additionally, the present invention provides a new and useful method and apparatus for converting the vapor degreaser using toxic solvents to the safer aqueous solution degreaser.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which the preferred embodiments of the invention are illustrated.

DESCRIPTION OF THE PREFERRED EMBODIMENTS

Figure 1:
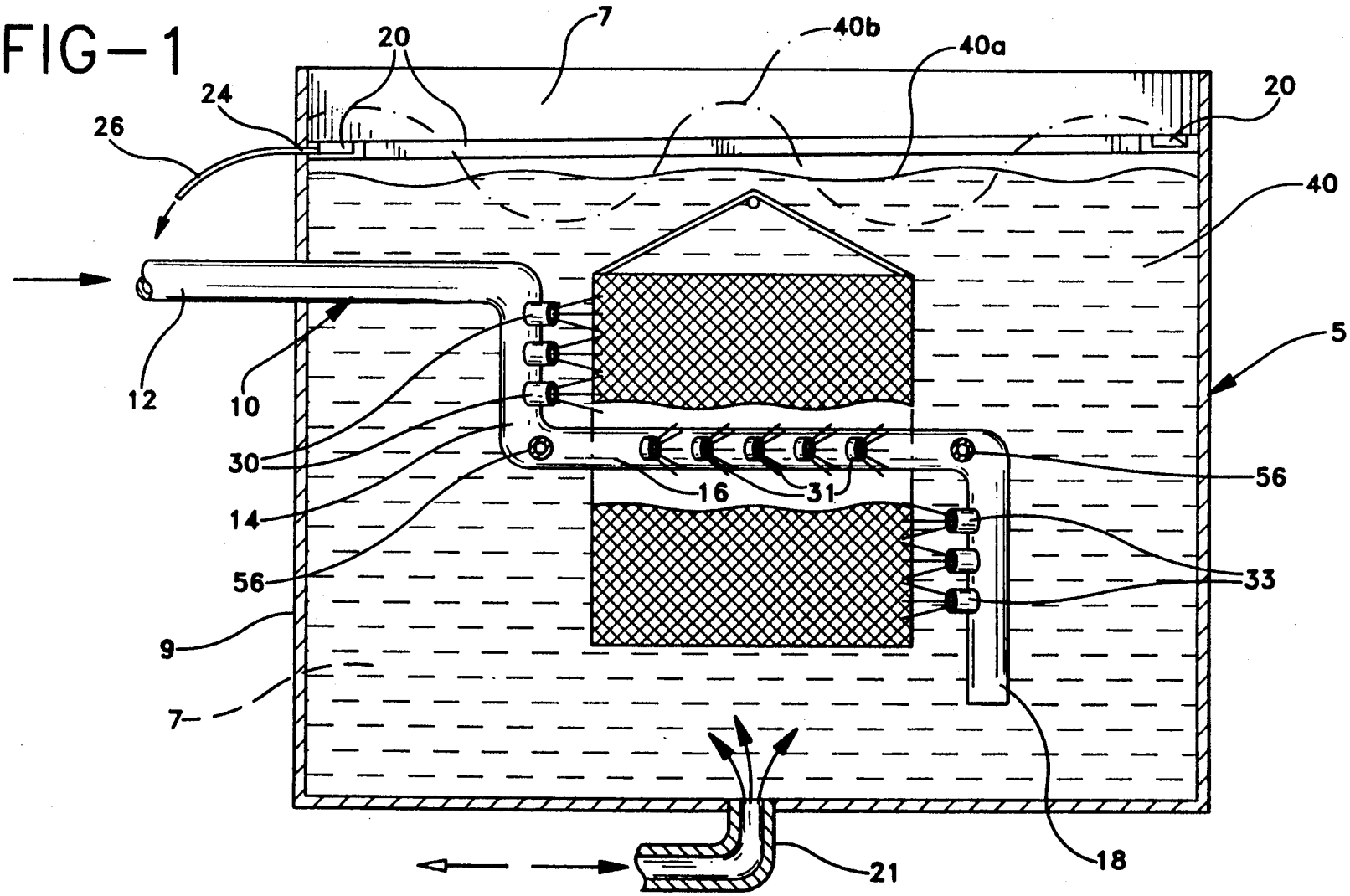
FIG. 1 is a front elevational view of a retrofit apparatus according to the present invention for cleaning contaminated parts.

Referring to the drawings in particular, the invention embodied in FIG. 1 comprises an aqueous solution wash tank 5 filled with hot aqueous solution 40 that is at a level 40*a* just below a trough 20 located near the top of the tank around the walls of the tank. A drain/supply 21 is at the bottom of the tank to fill or drain the tank at start-up and when out of service.

Figure 2:
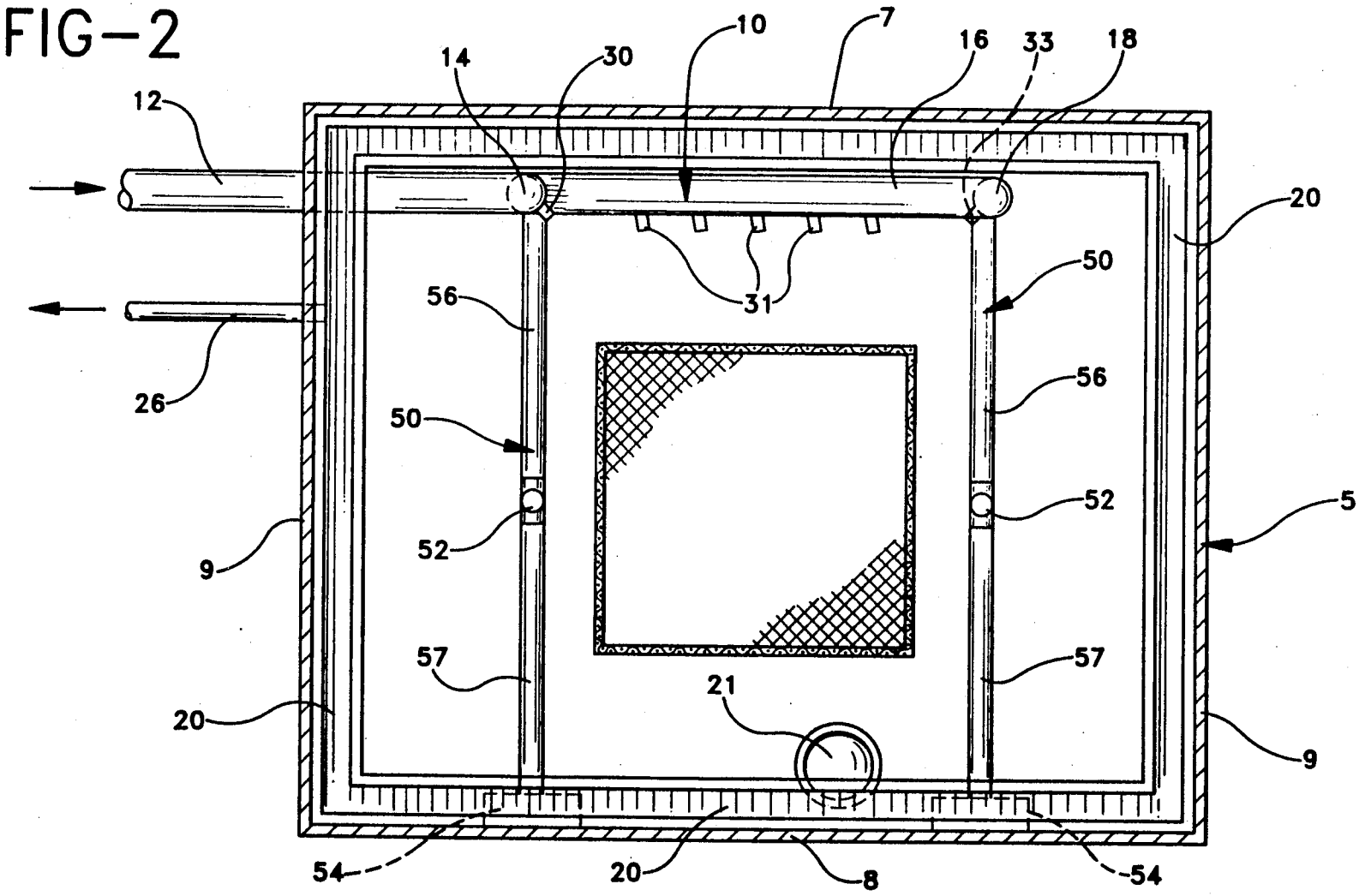
FIG. 2 is a top view of the retrofit apparatus according to the present invention.
Figure 5:
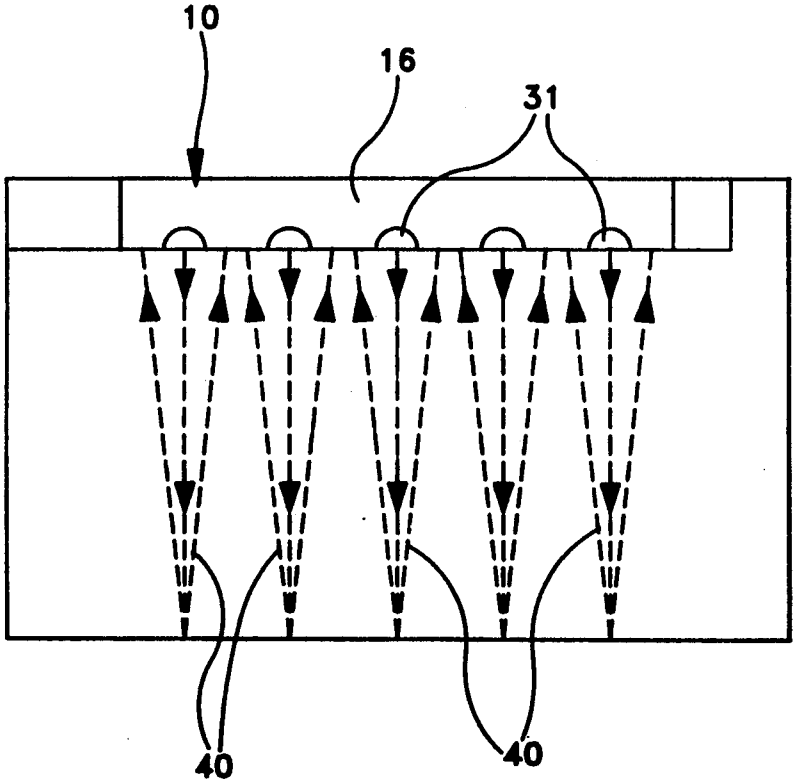
FIG. 5 is a top view of the agitation manifold shown in FIG. 1 in its spraying state.

An agitation manifold 10 is located at the back wall 7 of the tank 5 as shown in FIG. 2, and is positioned so that the aqueous solution level 40*a* is well above the agitation manifold 10. Tank 5 has side walls 9. The agitation manifold 10 has an inlet section 12 that is led into the tank 5 and extends in a horizontal position. An upper section 14 of the manifold 10 which is a vertical portion of the manifold 10 and is curved downward from the inlet section 12. The upper section 14 of the manifold 10 has a series of nozzles 30 that spray aqueous solution 40 at an angle as shown in FIG. 2, and at contaminated articles placed inside the tank 5. A mid-section 16 of the manifold 10, extends in a horizontal position at a lower level than the inlet section 12. The mid-section 16 of the manifold 10 is positioned at the back wall 7 of the tank 5 and has a series of nozzles 31 which spray aqueous solution at a slight angle toward the front wall 8 of the tank 5 as shown in FIG. 5. A lower section 18 of the manifold 10 is arranged in a vertical position parallel to the upper section 14 and located beneath the mid-section 16 of the manifold 10. The lower section 18 of the manifold 10 has a series of nozzles 33 that spray aqueous solution at an angle and at the contaminated parts inside the tank 5.

A perforated basket 36 containing contaminated parts or articles is submerged in the aqueous solution 40 inside the tank 5. The basket 36 is positioned inside the tank 5 such that the contents of the basket 36 are exposed to the nozzles 31 and 33 located at the upper section 14, the mid-section 16, and the lower section 18 of the manifold 10. As the aqueous solution 40 is sprayed through the manifold 10 through its nozzles the separated contaminants float to the top of the tank at the surface of the aqueous solution 40. The agitation and spraying action of the manifold 10 causes the solution level inside the tank 5 to rise above the trough 20 as shown at the dot-dash line **40*b* in FIG. 1. As the surface level of the aqueous solution 40 rises above the trough 20, the contaminants floating at the surface flow into the trough 20 in order to exit the tank 5**.

The trough 20 inside the tank 5 is pitched so that contaminants and trapped solution flow toward one side of the tank and exit the tank at a trough opening 24 and into a discharge pipe 26.

Figure 3:
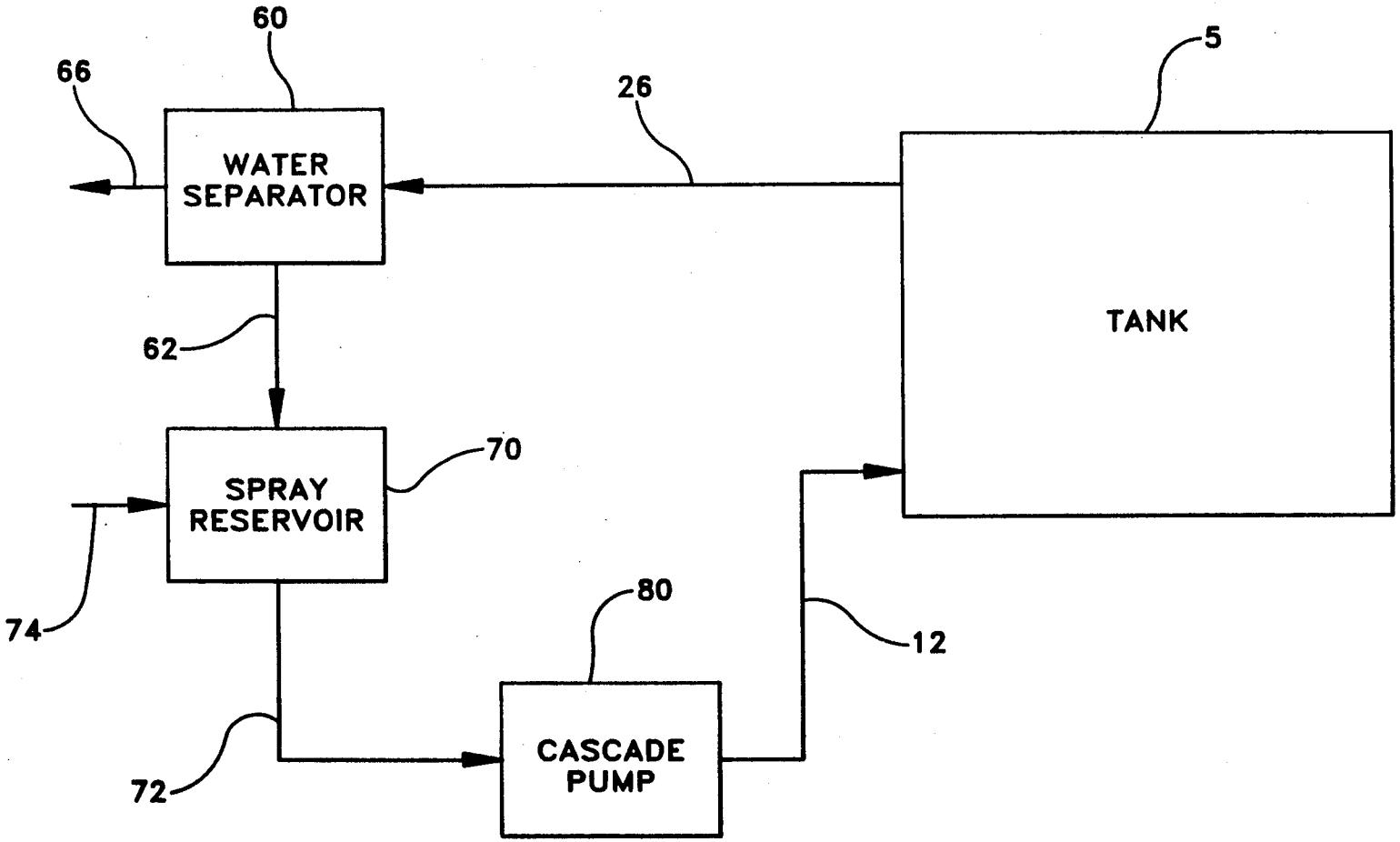
FIG. 3 is a schematic diagram of the degreasing system according to the present invention for cleaning contaminated parts and recycling the solution.
Figure 4:
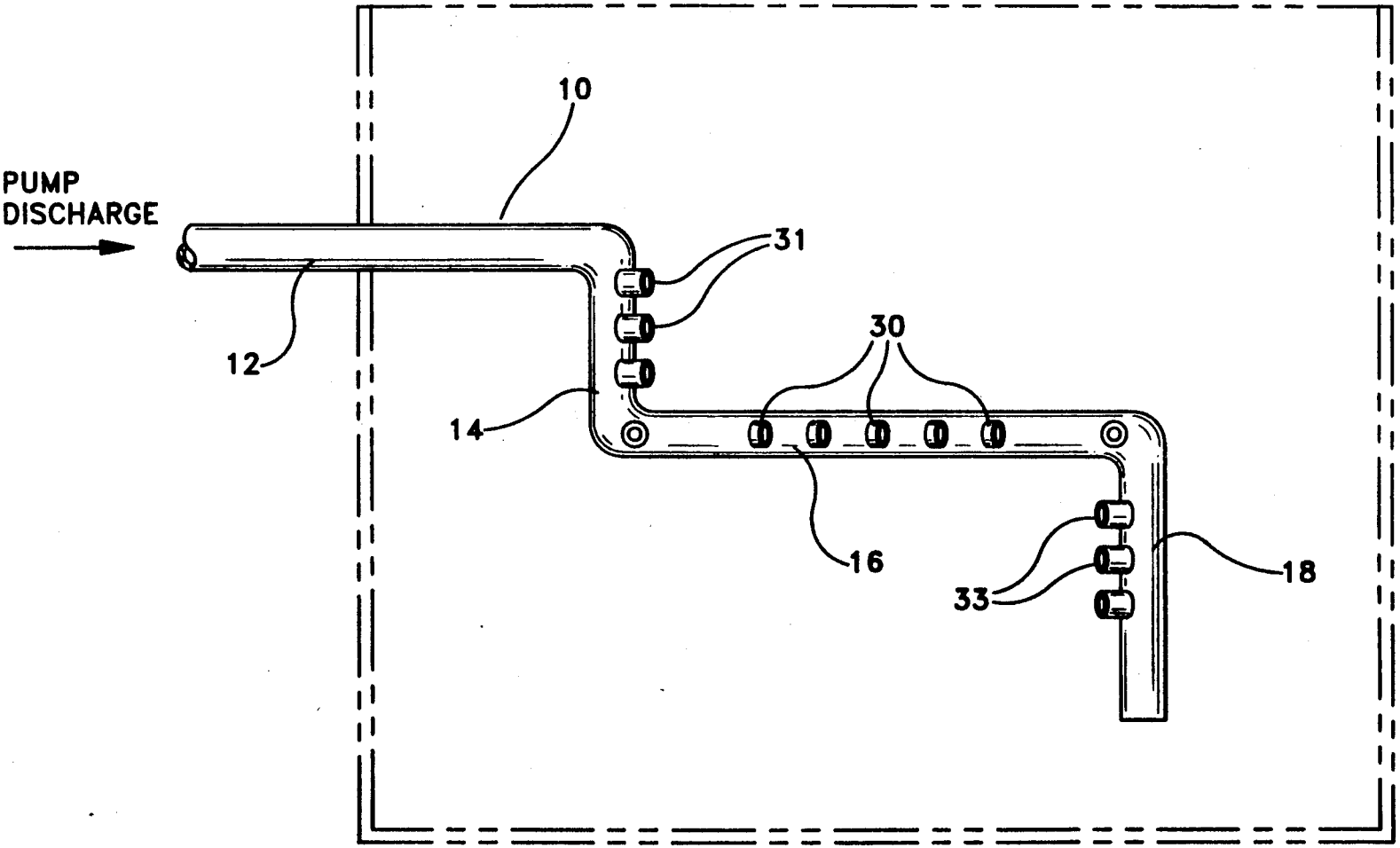
FIG. 4 is a side elevational view of the agitation manifold shown in FIG. 1.

FIG. 3 shows the aqueous degreasing system with the discharge pipe 26 extending from the tank 5 and containing the aqueous solution 40 with its contaminants which flows in a downward direction to a water separator 60. At the water separator 60 the solution is allowed to settle whereby the contaminants again will float at the surface of the aqueous solution 40 inside the water separator 60. The contaminants at the surface of the solution 40 inside the water separator 60 are bled off through a contaminant outlet 66 located near the upper portion of the water separator 60.

The solution 40 inside the water separator 60 is allowed to run downward and outside the water separator 60 through a separator exit 62 and into a spray reservoir 70.

The spray reservoir 70 receives the aqueous solution from the water separator 60 and additional fresh aqueous solution 40 through a solution inlet 74.

The aqueous solution 40 from the spray reservoir 70 is guided into a cascade pump 80 from the solution exit 72. The cascade pump 80 entraps any remaining contaminants and pumps the solution 40 back into the tank 5 through the inlet 12 of the agitation manifold 10.

FIG. 2 illustrates how the manifold 10 is secured inside the tank 5. A retainer 50 is located at each end of the manifold 10 for securing the manifold 10 inside the tank 5. The retainer 50 is a turnbuckle pipe arrangement having a retainer extending means 52 for receiving a specialized tool thus enabling the retainer 50 to be extended outwardly. As the specialized tool engages the retainer extending means 52, a fastener plate 54 attached at the opposite end of the retainer 50 from the manifold 10 extends outwardly to front wall 8 of the tank 5. This enables the plate 54 to rest firmly against the front wall 8 of the tank 5 and the manifold to be held against the rear wall 7.

Figure 6:
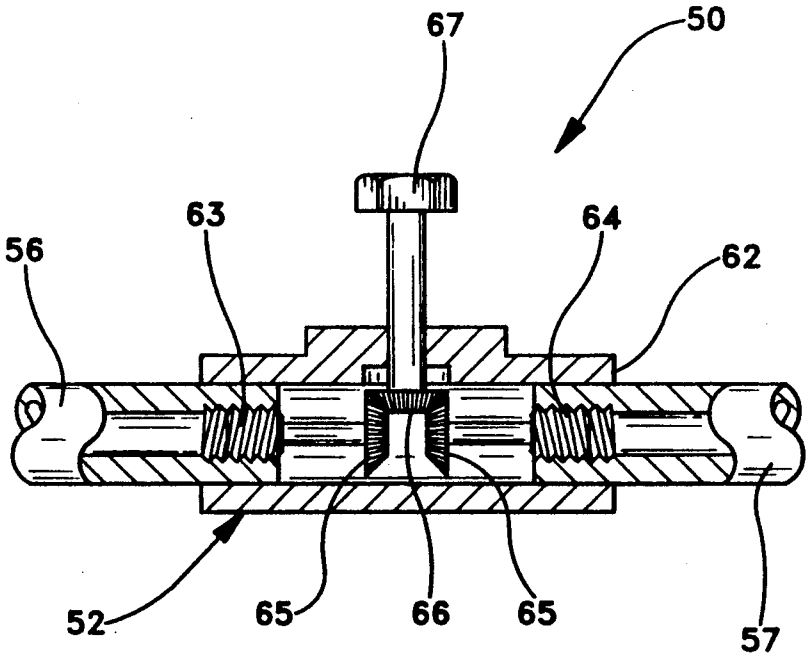
FIG. 6 is a sectional view of an extension mechanism for fixing the apparatus of the invention to a tank.

The retainer 50 is a conventional piece of hardware used for example in the boating industry and schematically shown in FIG. 6 in side sectional view. As shown in FIG. 6, the retainer includes a pair of internally threaded pipes 56 and 57. Pipe 56 is welded or connected be brackets to the manifold 10 and pipe 57 is connected to plate 54. A housing 62 slidably receives the adjacent ends of pipes 56, 57. A pair of externally threaded stubs 63 and 64 are threaded into the threaded ends of pipes 56 and 57 and each carry a bevel gear 65 which is meshed with a bevel gear 66 connected to a bolt 67 which is rotatably mounted to housing 62.

In order to fix the manifold in the tank, pipes 56 and 57 are spread apart by engaging bolt 67 with a tool from the top of the tank, rotating the bolt and thereby threading stubs 63 and 64 in opposite directions to spread the pipes 56, 57.

FIG. 5 illustrates the manifold 10 with nozzles inside the tank 5 spraying aqueous 40 from the nozzles. The manifold 10 with its mid-section 16 has nozzles 31 prearranged such that the nozzles spray aqueous solution 40 from the back wall of the tank 5 to the front wall 8 of the tank 5. The aqueous solution 40 sprayed from the nozzles located at the mid-section 16 of the manifold 10 spray the aqueous solution 40 with such force such that the aqueous solution 40 is forced to rebound off of front wall 8 of the tank 5 in a direction emanating toward the spacing between the nozzles 31 of the midsection 16 of the manifold 10. Nozzles 31 are shaped to angle the spray at a small angle to the wall 8 to cause this directional rebound.

While the specific embodiments of the invention have been shown and described in detail to illustrate the application of the principles of the invention, it will be understood that the invention may be embodied otherwise without departing from such principles.

What is claimed is:

1. A system for cleaning contaminants from unclean parts comprising:

a wash tank adapted to be filled with hot aqueous solution up to a fill level, for cleaning contaminated articles, the tank having a rear wall, opposite side walls and a front wall;

a manifold with spray nozzles secured in the wash tank below the fill level and near the rear wall, for spraying aqueous solution toward the front wall and for agitating the aqueous solution in the wash tank;

retainer means engaged with the front wall of the wash tank and the manifold, for retaining the manifold in the tank near the rear wall of the tank;

a trough arranged in the wash tank near the fill level and above the manifold for collecting a waste mixture of contaminated particles and agitated aqueous solution from near the fill level;

a waste discharge for discharging the waste mixture collected on the trough from the wash tank;

a separator for receiving the waste mixture from the waste discharge and for separating contaminated particles from aqueous solution discharged from the wash tank; and means for returning the separated aqueous solution from the separator to the manifold.

2. A system according to claim 1, wherein the manifold comprises:

an open end for receiving aqueous solution;

a closed end positioned opposite the open end for ending the flow of aqueous solution through the manifold;

a plurality of manifold sections for directing the flow of aqueous solution and for spraying of aqueous solution; and a series of spray nozzles arranged at each manifold section for spraying aqueous solution.

3. A system according to claim 2 wherein the manifold has three manifold sections wherein a first manifold section is arranged in a vertical position extending downwardly and perpendicular to the open end of the manifold, a second manifold section arranged in a horizontal position and perpendicular to the first manifold section and a third manifold section arranged in a vertical position perpendicular to the second manifold section and extending downward from the second manifold section.

4. A system according to claim 3 wherein a first series of spray nozzles is arranged at the first manifold section, a second series of spray nozzles is arranged at the second manifold section and a third series of spray nozzles arranged at the third manifold section.

5. A system according to claim 4, wherein the retaining means comprises means for applying pressure between the manifold and the front wall, to fix the manifold against the rear wall.

6. A system according to claim 5, wherein the retaining means includes a first securing member having one end engaged with the manifold and an opposite end extending toward the front wall, a second securing member having opposite ends, a plate connected to one end of the second securing member and engaged against the front wall, an opposite end of the second securing member extending toward the rear wall and to a position adjacent the opposite end of the first securing member, and spreading means engaged between the adjacent ends of the first and second securing members for spreading the first and second securing members to secure the manifold.

7. A system according to claim 2, wherein the manifold is made of one and one half inch diameter stainless steel piping.

8. A system according to claim 1, including a spray reservoir for collecting the aqueous solution separated from the contaminated particles in the separator; and a cascade pump for pumping recycled aqueous solution from the spray reservoir into the wash tank.

9. A system according to claim 8, wherein the cascade pump utilizes a rigid filter for trapping any remaining contaminants.

10. A system according to claim 9, wherein the rigid filter is a polypropylene cylinder.

11. A system according to claim 1, wherein the manifold is pressed against the back wall of the wash tank to retain the manifold.

* * * * *